United States Patent [19]

Queen

[11] 4,311,471

[45] Jan. 19, 1982

[54] STEERING MECHANISM FOR OUTBOARD MOTOR

[76] Inventor: Charles L. Queen, 2243 S. Highland Dr., Camano Island, Wash. 98292

[21] Appl. No.: 67,806

[22] Filed: Aug. 20, 1979

[51] Int. Cl.[3] ..... B63H 21/26

[52] U.S. Cl. ..... 440/63; 24/263 A; 74/480 B

[58] Field of Search ..... 115/18 R, 18 A, 35; 74/480 B, 522, 586; 403/43, 287, 299, 342, 343; 24/84 R, 84 A, 263 A; 440/53, 63

[56] References Cited

U.S. PATENT DOCUMENTS

| | | | |
|---|---|---|---|
| 1,639,735 | 8/1927 | Jones | 74/586 |
| 1,763,128 | 6/1930 | Bolland | 24/263 A |
| 2,899,833 | 8/1959 | Prier | 115/18 R |
| 3,143,795 | 8/1964 | Du Buc et al. | 74/522 |
| 3,756,186 | 9/1973 | Nordling | 115/18 R |
| 4,009,678 | 3/1977 | North | 74/480 B |
| 4,010,924 | 3/1977 | Parsons et al. | 24/263 A |
| 4,146,340 | 3/1979 | Smith | 74/586 |

*Primary Examiner*—Edward R. Kazenske

*Attorney, Agent, or Firm*—Hughes, Barnard & Cassidy

[57] ABSTRACT

A remote steering device adapted for attachment to a stern drive unit and an outboard motor affixed to the stern portion of a boat. The remote steering device comprises a pair of elongate members rotatably affixed to one another and having longitudinal axes of rotation, adapted such that a first elongate members may rotate about its longitudinal axis relative to the second elongate member without causing rotation of the second member. One of the elongate members is provided as a pair of telescoping members in order to vary the distance between the outer ends of the device. A ball-joint is adjustably affixed to each outer end of the remote steering device, and brackets are provided for attaching the device to the stern drive unit and the outboard motor. When the stern drive unit is raised to its upper inoperative position, the elongate members securely affixed to the stern drive unit and the outboard motor may rotate about the longitudinal axis to avoid twisting stresses. The outboard motor may thereby be steered by steering the stern drive unit when it is in either the upper or lower position.

4 Claims, 7 Drawing Figures

STEERING MECHANISM FOR OUTBOARD MOTOR

BACKGROUND OF THE INVENTION

Most of the larger pleasure and general fishing boats sold for non-commercial uses in the 16 to 24 foot range are provided with stern drive units, also called inboard/outboards, wherein the motor is within the boat hull, with a drive train extending through the transom to a stern-mounted drive unit carrying the propeller. While these stern drive units are capable of propelling the boat at a relatively high speed efficiently, it is either impossible, or very inefficient, to utilize such a motor to move the boat for long periods of time at very slow speeds, such as when trolling for fish. For this reason, many of these boats are provided with an auxilliary outboard motor, having considerably less horsepower and being much more efficient and inexpensive to operate when the boat is to be moved slowly.

The typical stern drive unit may be operated in a lower position with the propeller in the water, or the entire drive unit exterior of the boat hull may be tilted upwardly to remove the propeller from the water, thereby causing less drag when the smaller outboard motor is utilized. In order for the propeller of the outboard motor to reach beneath the water's surface, the outboard motor must be mounted to the boat transom below a level which would permit the boat owner to steer the motor with a conventional outboard motor handle extending across the rear gunwale. Therefore, it is advantageous to have an attachment which will permit the driver of the boat to utilize the boat's steering wheel which to steer the outboard motor when it is to be used. This attachment should permit the driver of the boat to steer the outboard motor with the steering wheel when the stern drive unit is in either the upward, non-operative position, or the lower operative position.

The problem encountered when using such a remote steering device when the stern drive unit is tilted upwardly, is that the end of the remote steering device affixed to the stern drive unit not only describes an arc as it moves with the stern drive unit, but also experiences a rotational movement about its longitudinal axis which, unless the device is permitted to rotate about its longitudinal axis, imparts significant twisting strain to the device leading ultimately to its failure.

Devices which permit an auxilliary engine to be controlled from a primary engine are well known in the prior art. U.S. Pat. No. 3,756,186, Nordling, illustrates an attachment which permits an outboard motor to be steered from a stern drive unit. The connecting mechanism includes a pair of telescopic members, each of which is connected through a universal joint to the outboard motor or the stern drive unit. A locking mechanism in the form of a pin extending through openings in both telescopic members is utilized to lock the telescopic members in any desired position depending upon the distance between the stern drive unit and the outboard motor. U.S. Pat. No. 3,567,164, Hakala, shows a support means which permits two outboard motors to be pivotally mounted thereto, so that an auxilliary outboard motor may be conveniently moved to a selected vertical position in water. U.S. Pat. Nos. 3,283,738, Nelson, 2,968,192, Fletcher, 2,899,833, Prier, and 2,744,418, Weber, all illustrate coupling or steering devices which permit a pair of outboard motors to be steered at the same time. U.S. Pat. No. 2,972,976, Smith, illustrates yet another device which permits a pair of stern drive units to be operated concurrently, or a single unit to be operated while the other is tilted or raised out of the water.

U.S. Pat. Nos. 4,009,678, North, 3,505,971, Dalke, and 3,473,764, Hopper, illustrate attachments to boat motors revealed in a patentability search, but which are not considered relevant to the present invention.

SUMMARY OF THE INVENTION

In the present invention, there is a stern drive unit and an outboard motor mounted to the transom of a boat, with a remote steering device adapted to be attached therebetween in order to steer the outboard motor from the cockpit portion of the boat. A first elongate member affixed to the stern drive unit and a second elongate member affixed to the outboard motor are provided, the first and second elongate members interfitting with one another so as to permit relative rotation of one of the elongate members about its longitudinal axis without causing rotation of the other elongate member. One of the elongate members is provided with an enlarged end portion, and the other elongate member is provided with a collar portion, such that the enlarged end portion is rotatably retained within the collar portion.

The outer ends of both of the elongate members are provided with ball-joints adjustably affixed thereto, the ball-joints being securely affixed to bracket members which are securely attached to the stern drive unit and the outboard motor. The mounting bracket which affixes the first elongate member to the stern drive unit comprises a U-shaped member having retaining flanges adapted to be affixed to the housing of the stern drive unit, and a threaded compression screw member adapted to interlock the flanges with the housing member. One of the elongate members is provided as a telescopic member so that the distance between the outer ends of the elongate members may be varied.

DETAILED DESCRIPTION OF THE PREFERRED EMBODIMENT

Figure 1:
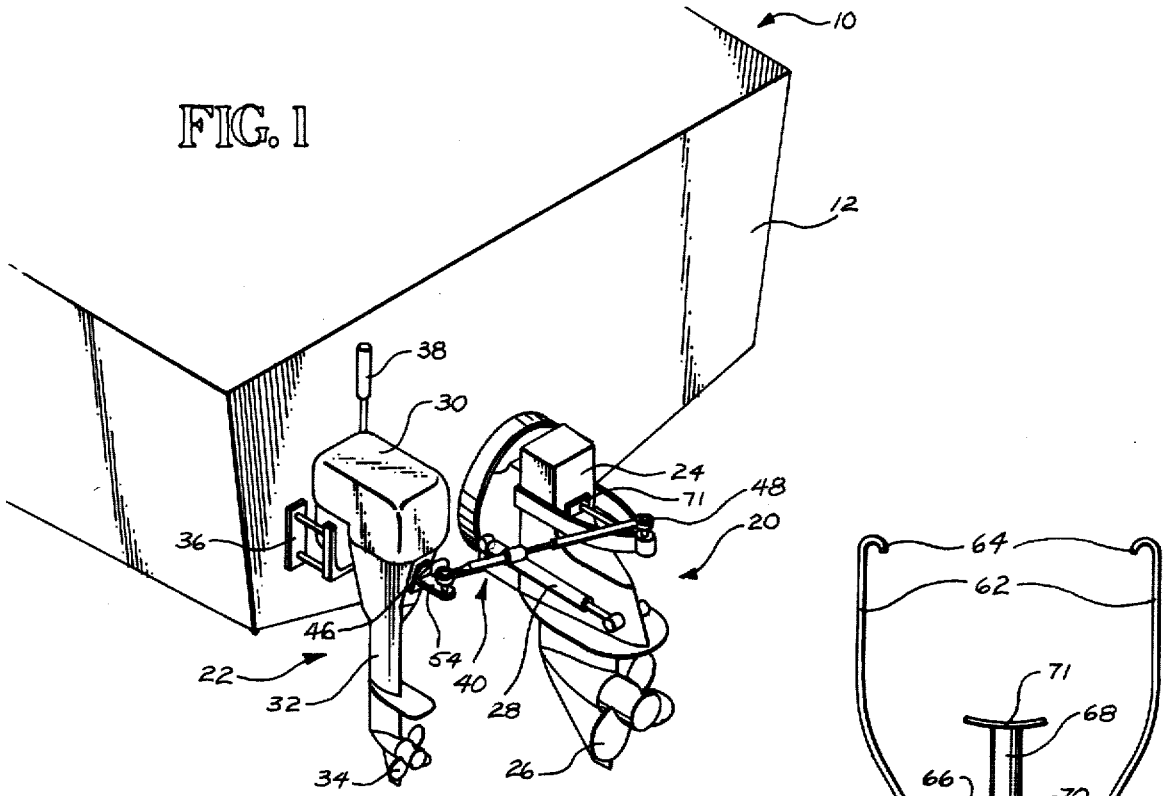
FIG. 1 is an isometric view illustrating the attaching member of the present invention in place on a stern drive unit and an outboard motor.

In the present invention, there is a boat, generally designated 10 and having a transom 12, an inboard/outboard stern drive propulsion unit 20 and an auxilliary outboard propulsion unit 22. The stern drive unit 20 is a typical primary propulsion system having a motor (not shown) within the boat hull, and a drive apparatus protruding through the transom 12 into the water. There is a housing 24 which surrounds portions of the main drive unit and transmission. The stern drive unit 20 may be moved from a first lower operating position wherein the propeller 26 is beneath the water's surface to a second upper inoperative position when the boat is to be used in shallow water, trailered or propelled by the outboard motor 22. The stern drive unit 20 is tilted between the upper and lower positions by hydraulically controlled piston and cylinder lift arms 28 on either side of the housing 24. The outboard motor 22 comprises a motor enclosed within housing 30, drive shaft 32 and propeller 34. The outboard motor mounting bracket 36 is usually placed low enough on the transom 12 so that the propeller 34 will be beneath the water surface, thereby making access to the outboard motor handle 38 either very inconvenient or impossible.

Figure 2:
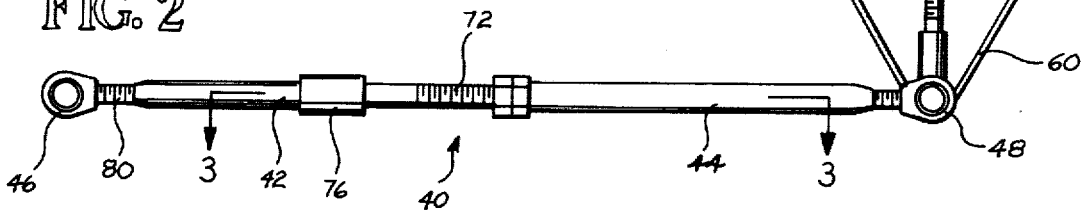
FIG. 2 is an isometric view of the present invention.
Figure 4:
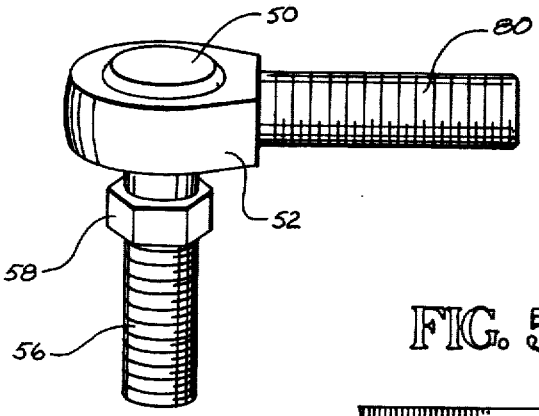
FIG. 4 is an isometric view of the ball-joint of the present invention.

Therefore, a remote steering device 40 is provided to interfit between the stern drive unit 20 and outboard motor 22 in order to steer the outboard motor by steering the stern drive unit when it is in either the first or second position. As shown more clearly in FIG. 2, the remote steering device 40 comprises first and second elongate members, 42 and 44 respectively, adapted to rotatably interfit relative to one another. Each elongate member 40 and 44 is provided with a ball joint, 46 and 48 respectively at the outer end thereof at its attachment to the respective motor. The ball joints 46 and 48 are constructed in any conventional manner, as shown in FIG. 4, such that a ball member 50 is permitted to freely rotate within a ball housing 52.

Figure 7:
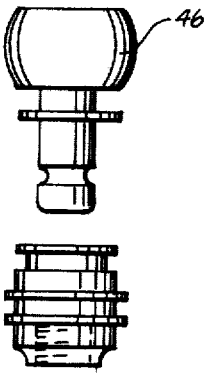
FIG. 7 is an isometric view of a quick-release ball joint of the present invention.

The ball joint 46 is affixed to the outboard motor 22 at mounting bracket 54, which is affixed to the external housing of the drive shaft 32 so as to extend rearwardly therefrom in a horizontal plane. A threaded extension 56 of the ball member 50 is secured to the mounting bracket 54 with nut 58. Ball joint 48 is affixed to the mounting bracket 60 in the same manner. Alternatively, the ball joints 46 and 48 may be affixed to the mounting brackets 54 and 60 by means of any conventional quick-release mechanism, as shown in FIG. 7. The mounting bracket 60 comprises a pair of U-shaped arms 62 which are provided with retaining flanges 64 adapted to secure the bracket 60 to a portion of the housing 24 of stern drive unit 20. The retaining flanges 64 may be configured in any manner to interfit with different stern drive housings. The mounting bracket 60 is secured to the housing 24 by compression member 66, which comprises an extensible portion 68 threaded upon a base portion 70, with a pad portion 71 abutting the housing 24. As the extensible portion 68 is threaded outwardly toward the housing member 24, the ball joint 48 is directed away from the stern drive unit 20, so that the retaining flanges 64 are securely attached to the housing 24.

Figure 3:
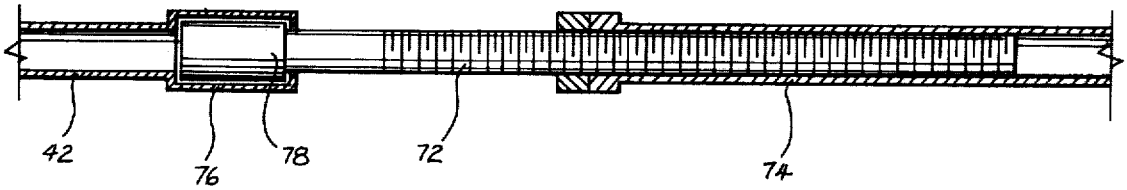
FIG. 3 is a longitudinal sectional view taken above line 3—3 of FIG. 2.

One of the elongate members (as shown in FIG. 3, the second elongate member 44) is provided as a pair of members 72 and 74 which interfit in telescopic relationship with one another, such that the member may be adjusted to any desired length. The telescoping members 72 and 74 may be retained at a specific location relative to each other in any desired manner, and as shown herein, a smaller member 72 is threaded within the larger telescopic member 74.

The first and second elongate members 42 and 44 are arranged to permit rotation of one member about its longitudinal axis relative to the other member. This may be accomplished by placing a collar member 76 about an enlarged end portion 78 of the smaller telescopic member 72 of second elongate member 44, and then affixing the collar member 76 to the end of elongate member 44, such as by welding. Therefore, the second elongate member will be fixedly secured to the first elongate member 42, with each of the members being permitted to rotate about its longitudinal axis without causing the other elongate member to so rotate. To provide a further adjusting feature varying the length of the steering device, the ball joints 46 and 48 are secured to the first and second elongate members in adjustable relationship. The ball housing 52 may be secured to the elongate member by threading a bolt portion 80 into the outer end of the elongate member, or by utilizing a quick-release member as shown in FIG. 7.

Figure 5:
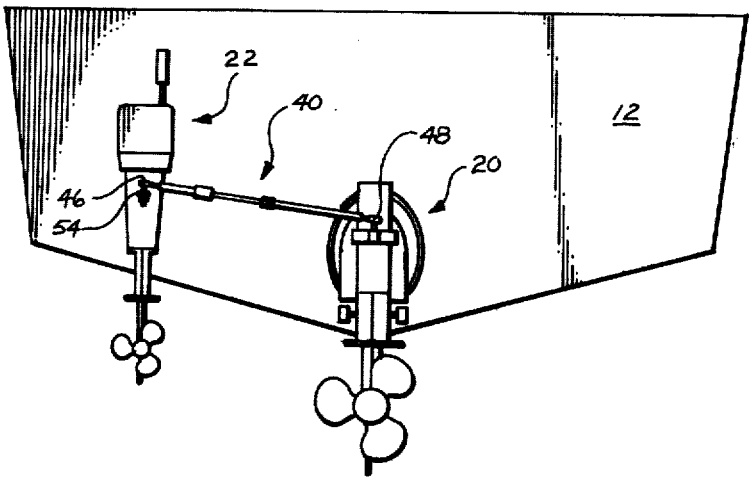
FIG. 5 is an isometric view of the present invention in place with the stern drive unit in the lower operating position.
Figure 6:
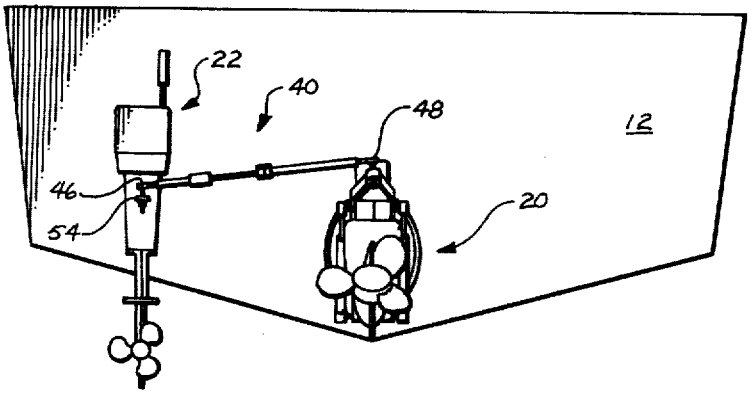
FIG. 6 is an isometric view of the present invention in place with the stern drive unit in the upper inoperative position.

As shown in FIGS. 5 and 6, the remote steering device 40 of the present invention may be utilized to effect remote steering of the outboard motor 22 when the stern drive unit is in the lower operating position (FIG. 5) or the upper inoperative position (FIG. 6). When the stern drive unit is tilted upwardly to its inoperative position the outer end of the second elongate member 44 is moved upwardly and toward the transom 12 of the boat. Because the outboard motor 22 must usually be placed somewhat higher on the transom than the stern drive unit 20, the remote steering device 40 may not extend perfectly horizontally between the outboard motor and the stern drive unit. When the stern drive unit is tilted upwardly to its inoperative position, the ball joint 48 associated with the stern drive unit will typically move from a position below the ball joint 46 associated with the outboard motor (as shown in FIG. 5) to a position somewhat above ball joint 46. Because the ball joint 48 moves not only vertically, but also laterally toward the transom, the ball joint 48 describes an arc which displaces the ball member 50 and its extension 56 at an angle to the housing 52. At this point, the ball member 50 "crimps" within the housing 52, preventing further rotational movement of the ball member within the housing. As the ball joint 46 continues moving in the arc toward the transom 12, twisting loads are placed upon the elongate member 44 as the stern drive unit 20 approaches its uppermost position. In order to prevent damage to the remote steering device 40 due to this twisting action, the second elongate member 44 is permitted to rotate about its longitudinal axis while still being retained within collar member 76. In this manner, the twisting stresses applied to the remote steering device when moving the stern drive unit from its lower to its upper tilted position are relieved by the rotational movement of the second elongate member 44.

What is claimed is:

1. A remote steering device adapted to for use in a boat comprising:

(a) a stern drive unit mounted to a transom of said boat for rotation about a first horizontal axis between a first lower operating position and a second upper inoperative position, said stern drive unit being steerable from a cockpit portion of said boat, (b) an outboard motor mounted external of said boat to said transom for rotation about a second horizontal axis between a first lower operative position and a second upper inoperative position, said remote steering device adapted for attachment to said stern drive unit and said outboard motor in order to steer said outboard motor from said cockpit portion of said boat, said device comprising:

(a) a first bracket adapted to be mounted to said stern drive unit, said first bracket comprising:

(i) a pair of U-shaped arms having first and second ends, the first ends of the U-shaped arms having mounting portions to engage a front face portion of said stern drive unit, said arms extending along opposite sides of the stern drive unit with the second ends joining to one another at a location directly rearwardly of a rear face portion of the stern drive unit, (ii) a connecting member connected to the second ends of the arms and engaging said rear face portion of said stern drive unit to rigidly hold said U-shaped arms to said stern drive unit, (b) a first ball joint connected to said first bracket at the second ends of the arms, said first ball joint having a first ball housing and a first ball member mounted in the first ball housing for rotation about three axes mutually perpendicular to one another, (c) a second bracket adapted to be attached to said outboard motor at a location rearwardly thereof, (d) a second ball joint connected to said second bracket at a location directly rearwardly of the outboard motor, said second ball joint having a second ball housing and a second ball member mounted in the second ball housing for rotation about three axes mutually perpendicular to one another, (e) a first elongate member having a first longitudinal axis and also having first and second ends, said first end being connected to said first ball joint in a manner to be able to rotate about said first longitudinal axis and also about axes of rotation perpendicular to the first longitudinal axis, (f) a second elongate member having a second longitudinal axis and having first and second ends, said first end of the second elongate member being connected to the second ball joint to be able to rotate about the longitudinal axis of the second member, and also about axes of rotation perpendicular to the second longitudinal axis, (g) the second ends of the two elongate members being connected to one another to permit relative rotation therebetween about the first and second longitudinal axis, but preventing relative rotation about axes angled to the first and second longitudinal axes, (h) at least one of said first and second members being a telescoping member capable of having its axial length changed so as to accommodate different distances between the stern drive unit and the outboard motor.

2. The device as recited in claim 1, wherein said first elongate member is provided with an enlarged end portion at the second inner end thereof, and said second elongate member is provided with collar portion at the second inner end thereof, such that said enlarged end portion of said first elongate member is rotatably retained within said collar portion of said second elongate member, thereby permitting rotation of either of said first or second elongate members relative to the other member without causing rotation of the other said elongate member.

3. The device as recited in claim 1, wherein said telescoping member comprises a first internally threaded portion and a second externally threaded portion adapted to interfit with one another, such that the length of said telescoping member can be adjusted by rotating the portions relative to one another.

4. The device as recited in claim 1, wherein said connecting member comprises a compression member comprising a base portion connected to the second ends of the arms and an extension member extensibly mounted to the base member to extend forwardly therefrom to engage the rear face portion of the stern drive unit, a pad member mounted to the extension member to press against said rear face portion of the stern drive unit in a manner to coact with said arms so that said first mounting bracket is securely mounted to said stern drive unit.

* * * * *